US006325249B1

(12) United States Patent
Keller

(10) Patent No.: US 6,325,249 B1
(45) Date of Patent: Dec. 4, 2001

(54) MANUALLY OPERATED DISPENSING DEVICE FOR A DOUBLE DISPENSING CARTRIDGE

(76) Inventor: Wilhelm A. Keller, Obstgartenweg 9, CH-6402 Merlischachen (CH)

( * ) Notice: Subject to any disclaimer, the term of this patent is extended or adjusted under 35 U.S.C. 154(b) by 0 days.

(21) Appl. No.: 09/504,726

(22) Filed: Feb. 16, 2000

Related U.S. Application Data

(60) Continuation-in-part of application No. 09/346,529, filed on Jul. 2, 1999, now Pat. No. 6,182,867, which is a division of application No. 08/803,856, filed on Feb. 21, 1997, now Pat. No. 5,992,694.

(30) Foreign Application Priority Data

Feb. 21, 1996 (EP) ..... 96810101
Nov. 12, 1996 (EP) ..... 96810778

(51) Int. Cl.[7] ..... B05C 17/01
(52) U.S. Cl. ..... 222/137; 222/326; 222/391
(58) Field of Search ..... 222/137, 145.1, 222/327, 391; 74/112, 116, 141.5, 148, 169

(56) References Cited

U.S. PATENT DOCUMENTS

| | | | | |
|---|---|---|---|---|
| 958,994 | | 5/1910 | Davis | 222/391 |
| 2,138,045 | | 11/1938 | Seeberger | 74/148 |
| 2,229,839 | | 1/1941 | Crewe | 222/391 |
| 4,452,285 | | 6/1984 | Liebhard et al. | 141/392 |
| 4,749,106 | * | 6/1988 | Von Schuckmann et al. | 222/391 |
| 5,137,181 | | 8/1992 | Keller | 222/134 |
| 5,248,068 | | 9/1993 | Goergen et al. | 222/326 |
| 5,314,092 | | 5/1994 | Jacobsen et al. | 222/137 |
| 5,336,014 | * | 8/1994 | Keller | 222/137 |
| 5,400,925 | | 3/1995 | Simmen | 222/137 |
| 5,775,539 | * | 7/1998 | Bates et al. | 222/327 |

FOREIGN PATENT DOCUMENTS

| | | |
|---|---|---|
| 0 408 494 | 1/1991 | (EP) . |
| 0 543 776 | 5/1993 | (EP) . |
| 0 615 787 | 2/1994 | (EP) . |
| 905049 | 9/1962 | (GB) . |
| 2153009 | 8/1995 | (GB) . |

* cited by examiner

*Primary Examiner*—J. Casimer Jacyna
(74) *Attorney, Agent, or Firm*—Foley & Lardner

(57) ABSTRACT

A manually operated dispensing device for use with a double cartridge for dispensing two-component chemical systems includes a double thrust ram with two thrust ram parts each having a toothed surface on which teeth are provided. The width of the thrust ram parts may be equal, or alternatively, the one thrust ram part may be wider than the other. The dispensing device further includes a drive assembly for acting on the double thrust ram, which is actuated by a trigger lever. The drive assembly includes a drive member, which includes teeth for acting on the teeth of the double thrust ram. The toothed surface of the thrust ram parts are either provided with ribs arranged near the outer edges of the thrust ram parts or have no ribs at all. As a result, a maximum width of the teeth is obtained and a maximum force is transmitted.

50 Claims, 7 Drawing Sheets

MANUALLY OPERATED DISPENSING DEVICE FOR A DOUBLE DISPENSING CARTRIDGE

CROSS REFERENCE TO RELATED APPLICATIONS

This application is a continuation-in-part of application Ser. No. 09/346,529 filed Jul. 2, 1999, now U.S. Pat. No. 6,182,867, which is a divisional of application Ser. No. 08/803,856 filed Feb. 21, 1997 now U.S. Pat. No. 5,992,694. The respective disclosures of both application Ser. Nos. 09/346,529 and 08/803,856 are hereby incorporated by reference.

BACKGROUND OF THE INVENTION

The present invention relates to a manually operated dispensing device for use with a double cartridge for dispensing two-component chemical systems. More particularly, it relates to a device that comprises a double thrust ram with two thrust ram parts each having a toothed surface on which teeth are provided, wherein the width of the thrust ram parts are equal or nearly equal, or, alternatively one thrust part is wider than the other. The device further comprises a drive assembly acting on the double thrust ram, which is actuated by a trigger lever, the drive assembly including a drive member which has a toothed surface with teeth for acting on the teeth of the double thrust ram.

A related dispensing device is already known from EP-A-0,615,787 to the same Applicant. This device had certain advantages over the prior art known at that time in that it could be manufactured with lower cost parts, such as plastic materials, due to the simultaneous meshing of a plurality of teeth. However, it has now been found that this device may still be substantially improved. In particular jamming, which is caused in the guide members by having a linear engagement movement, is a problem when used during the application of high dispensing forces. In addition, high jamming or tilting moments are created in that the driving dog must be guided with respect to the housing by an additional slider whose connecting link is disposed in a disadvantageous manner below the center line of the reactive force, particularly when the supply cylinders of the cartridges have the same or only slightly different diameters. Also, the lateral force impact point of cartridges having different diameters, especially widely different cylinder diameters, is not appropriately located. This results in all cases in a substantial loss of mechanical efficiency.

Another dispensing device has become known from U.S. Pat. No. 5,314,092, wherein the thrust rams acting on supply cylinders having different diameters are not symmetrically disposed, but rather are offset to the side having the higher reactive forces. The driving arrangement, however, does not provide a compensating link.

The thrust ram of known devices of the prior art, if they are made of plastic material, have reinforcing webs on both surfaces. The webs of these known devices are disposed away from the edges, e.g. in the center of each thrust ram part, thus leaving only restricted placement for the teeth.

SUMMARY OF THE INVENTION

In accordance with an aspect of the invention, a manually operated dispensing device for use with a double cartridge for dispensing two-component chemical systems includes a double thrust ram with two thrust ram parts each having a toothed surface on which teeth are provided. The width of the thrust ram parts may be equal, or alternatively, the one thrust ram part may be wider than the other. The dispensing device further includes a drive assembly for acting on the double thrust ram, which is actuated by a trigger lever. The drive assembly includes a drive member, which includes teeth for acting on the teeth of the double thrust ram. The toothed surface of the thrust ram parts are either provided with ribs arranged near the outer edges of the thrust ram parts or have no ribs at all. As a result, a maximum width of the teeth is obtained and a maximum force is transmitted.

BRIEF DESCRIPTION OF THE DRAWINGS

The invention will be described as follows by means of embodiments thereof with reference to the accompanying drawing, wherein.

DETAILED DESCRIPTION OF THE PREFERRED EMBODIMENT

Figure 1:
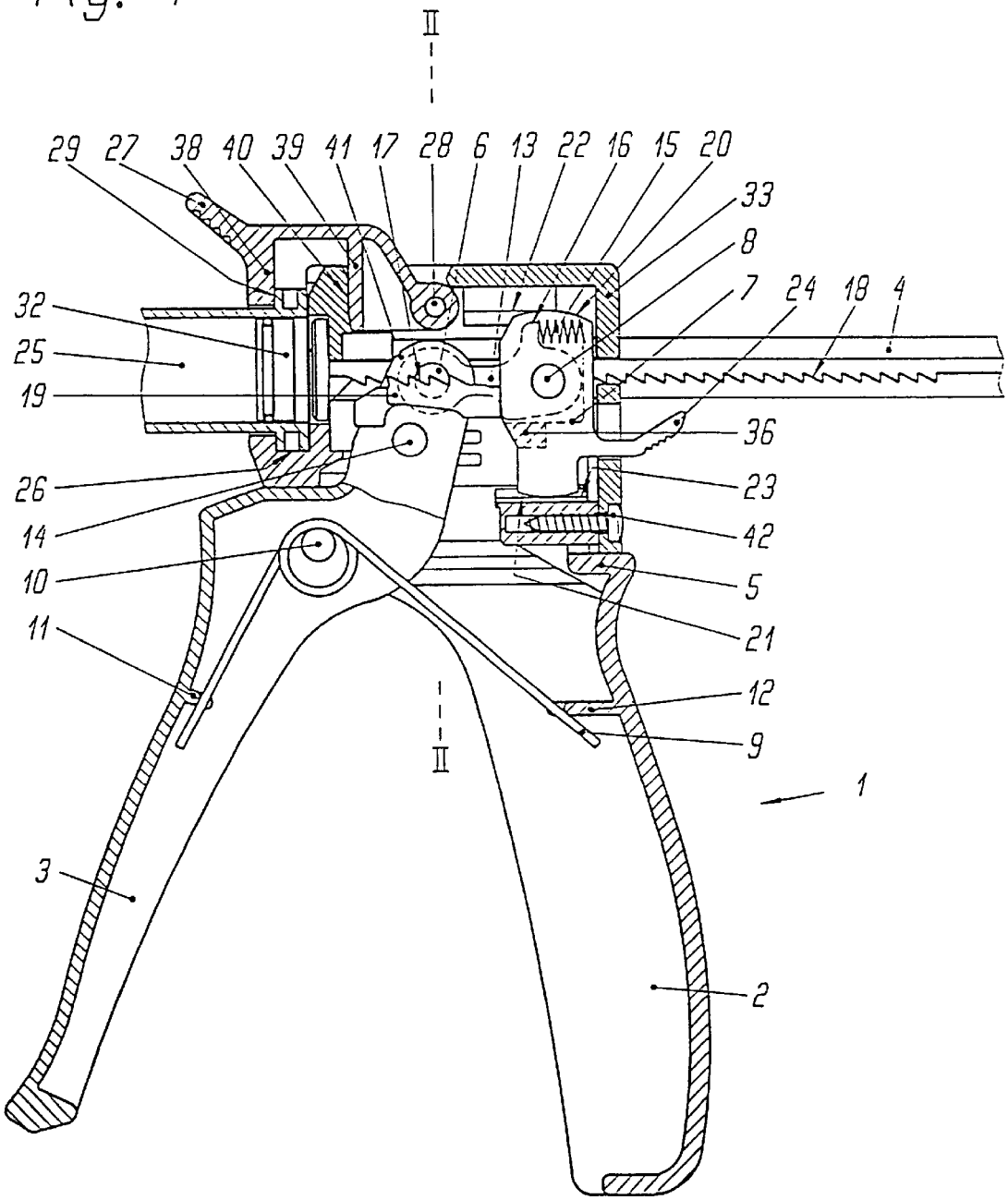
FIG. 1 shows a longitudinal section of a dispensing device according to the invention.

As used in the description and drawing, the side comprising the handle 2 is "below," and the opposite side comprising the retaining flap 27, is considered as "above," as shown in FIG. 1.

The device 1 comprises a handle 2 having a trigger lever 3 which acts via actuating parts on a double thrust ram 4 which, in turn, acts on the dispensing pistons 32 of a double cartridge 25 in order to deliver the two chemical components from the cartridge. The handle 2 is integral with the housing 5, this housing 5 containing different guides, ribs etc., as well as a cover 33; these parts will be described in more detail in the following description.

The trigger lever 3 is connected via an upper pin 6, which is the point of drive force impact of the trigger lever, to one end of a compensating link 13 which serves as an arc compensation and whose other end is connected by a pin 8 to a drive member 7, this pin 8 also acting as a fulcrum for pivoting the drive member 7. The trigger lever 3 pivots about an axle 14 which is journalled in the housing slightly below the upper pin 6. A compression spring 15 rests against a nose 16 of the compensating link 13 while pushing against the drive member 7.

As can be seen from FIG. 1, the upper pin 6, which receives the point of drive impact force of the trigger lever 3 and the pin 8 as the fulcrum of the drive member 7, are located between the two parts of the toothed double thrust ram 4, on the same level of a set of teeth 18 associated with the double thrust ram 4. This arrangement avoids vertical jamming and tilting moments. The set of teeth 18 is preferably situated within, or as close as possible to, the plane of the longitudinal axes of the cartridge containers.

Figure 2:
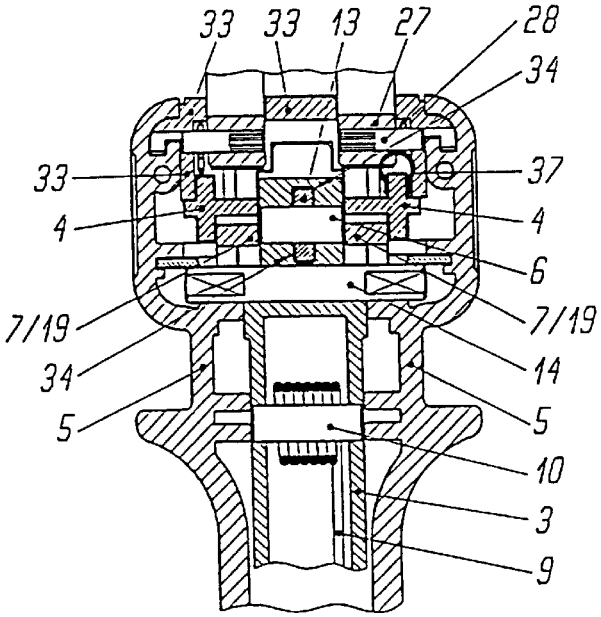
FIG. 2 shows a section of the dispensing device of FIG. 1 according to line II—II.

Furthermore, the trigger lever 3 is tensioned by a spring 9 which is movably attached to a pin 10 and abuts against a rib 11 of the trigger lever and a rib 12 of the handle. The drive member 7 comprises, as viewed in the direction of discharge, an upper set of teeth 17 which meshes with the set of teeth 18 of the double thrust ram. As is shown in FIG. 2, the compensating link 13 is laterally guided in a slot 34 of the trigger lever 3 at one end and in a slot of the drive member 7 at the other end, as indicated in dashed lines in FIG. 1, so that jamming of the compensating link is prevented.

Figure 4:
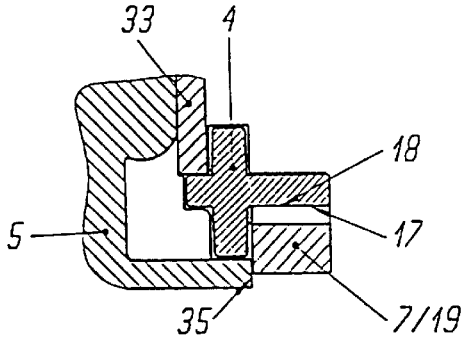
FIG. 4 shows a detail of FIG. 2 in an enlarged scale.
Figure 3:
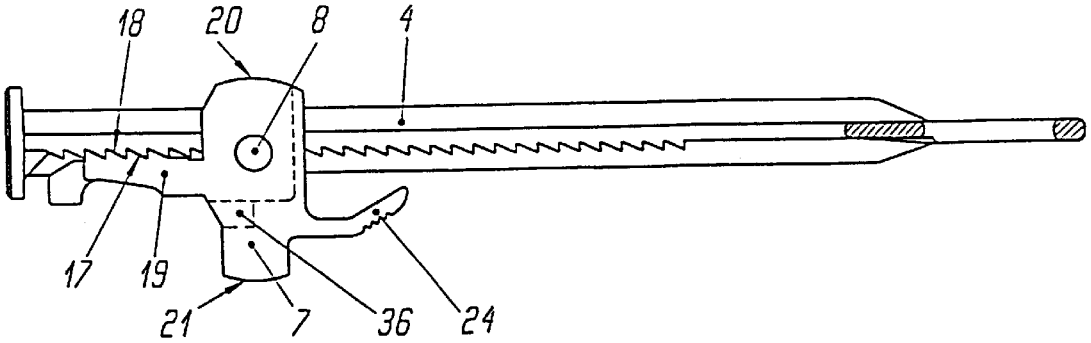
FIG. 3 shows a detail of the drive member.

The drive member 7, which has a slide and latch like configuration and comprises two arms 19 provided with teeth 17 on their upper sides, is laterally guided by side guides 35 of the housing, as shown in FIG. 4, thus preventing its tilting or jamming. As can be seen in FIG. 1, the drive member 7 is additionally guided in grooves 22 and 23 of the housing, the upper side 20 and the lower side 21 of the drive member 7 being rounded as part of an arc of a circle so that it is still able to make a slight swiveling movement but cannot deviate upward, downward or laterally. The drive member thus makes a linear advancing and retracting movement. The drive member 7 further comprises an integral lever 24 for disengaging teeth 17 from the teeth 18 of the double thrust ram 4 for its retraction.

It is evident from the description and the figures that, when the trigger lever 3 is actuated, it will pivot about the pin 14, journalled in the housing, and will entrain the compensating link 13 by means of the upper pin 6 in the forward direction, namely in the dispensing direction. The compensating link 13 pulls the drive member 7, whose teeth 17 is engaged with the teeth 18 of the double thrust ram 4, through the pin 8 to the left in FIG. 1 and entrains the double thrust ram 4 in the dispensing direction. During the advance stroke, the teeth of the drive member 7 meshes without any movement relative to the teeth of the double thrust ram. The compression spring 15 which rests against the nose 16 of the compensating link 13 and which is located above the pin 8, ensures that the meshing of the teeth of the drive member 7 and of the double thrust ram 4 is also maintained after the return stroke movement of the drive member 7. Furthermore, a stop 36 on the drive member 7 limits the swiveling angle of the drive member 7. The lever 24 allows a swiveling disengagement of the drive member and thus a retraction of the double thrust ram 4.

By the use of a compensating link which is fastened by, yet pivotable about, the two pins 6 and 8 in the plane of teeth 17 and teeth 18, and by the use of a linearly guided drive member 7, which may allow small swiveling motions during the return stroke or for the retraction of the thrust ram 4, a state whereby no relative motion between the teeth 17 of the drive member 7 and the teeth 18 of the thrust ram 4 is achieved. It is thus possible to have several teeth meshing simultaneously.

This is a significantly advantageous condition to achieve exact meshing of the teeth and a relatively low specific surface load on those teeth during the whole dispensing stroke. Further, since several teeth are in simultaneous meshing engagement, the shear forces per tooth are lower.

Since the pins 6 and 8, as well as the teeth 17 and 18, are situated in about the same plane, it follows that the entire friction forces generated in the device are considerably lower than in those according to the prior art. The thus increased efficiency results in a lower load on the individual parts and requires considerably lower hand forces on the trigger lever.

In the first embodiment according to FIGS. 1 to 5, the device may comprise a thrust ram return brake in the form of a friction brake, as disclosed in the above mentioned device according to EP-A-0,615,787. This friction brake may also be designed as an omega shaped spring 37, as shown in FIG. 2.

Figure 6A:
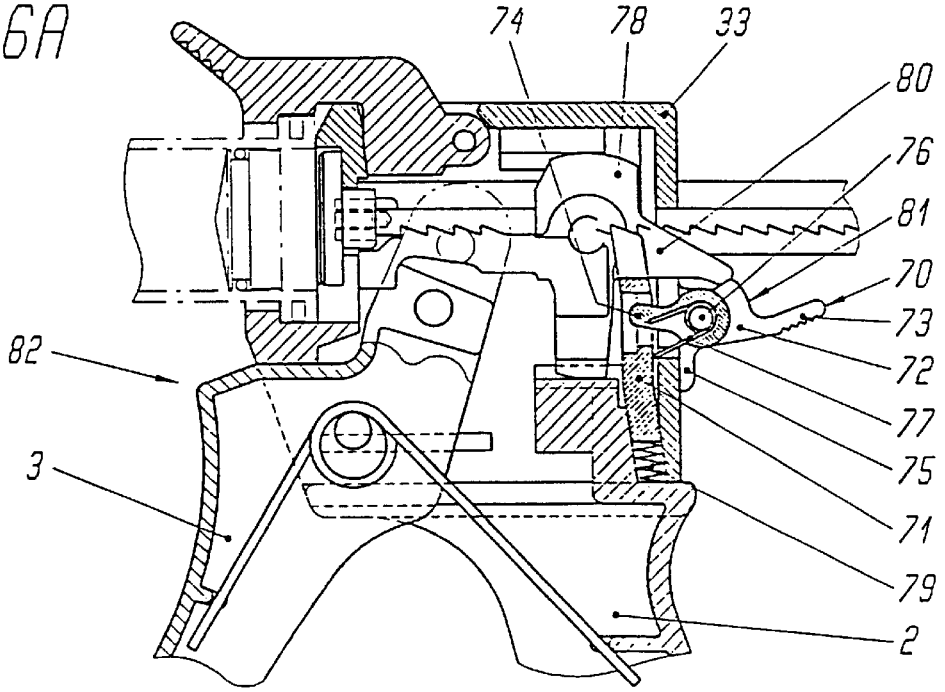
Figure 6B:
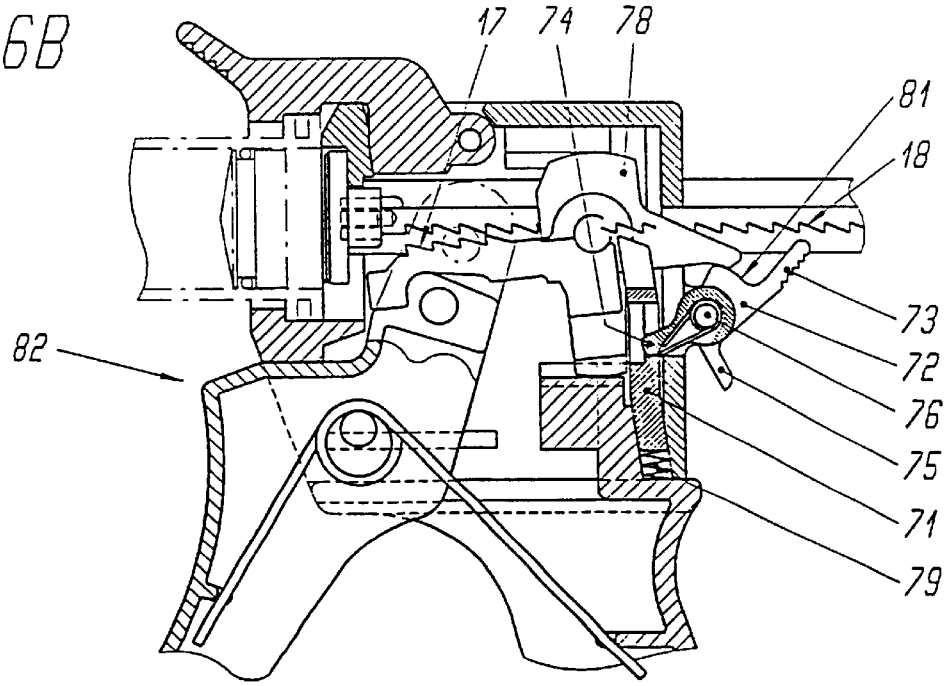

In order to prevent the double thrust ram from any return motion, or to allow a limited return motion only, it may be provided with a return stop device comprising a locking slider as shown in FIGS. 6A and 6B. FIG. 6A shows the locked position and FIG. 6B the unlocked one, instead of with the friction brake mentioned above.

The automatically acting return stop device 70 of the dispensing device 82 comprises a locking slider 71 and an unlocking lever 72 acting thereon. The unlocking lever 72 consists of an actuating lever 73, a nose 74 and a stopper dog 75 and is pivotable around the axle 76. The nose 74 is charged by a leg spring 77 that pushes the unlocking lever 72 with its stopper dog 75 against the cover 33. A compression spring 79 pushes the locking slider 71 into a free tooth space of the teeth 18 of the double thrust ram 4 thus hindering the latter from going back by more than a limited distance or not at all.

For the return motion of the double thrust ram 4, it is required that the drive member 78 is disengaged and the locking slider 71 is unlocked, i.e. withdrawn from the engaging region of the teeth 18. This is accomplished by manually swiveling the lever actuating 73 to rotate the unlocking lever 72 about the axle 76. The actuating lever 73 of the unlocking lever 72 presses upon the projection 80 of the drive member 78 and disengages its teeth 17 from the teeth 18 of the double thrust ram 4. The drive member 78 is identical with the drive member 7, with the exception of the integral lever 24, which is replaced by the projection 80. Furthermore, the locking slider 71 is moved downward by the nose 74 of the unlocking lever 72 acting on the unlocking slider. A radial cam 81, being a part of the unlocking lever 72 and cooperating with the projection 80 of the drive member 78, ensures that first the drive member 78, and then only afterwards the locking slider 71, are disengaged. This arrangement achieves that reaction forces, emanating from the cartridge while still under pressure, are transmitted via the double thrust ram 4 and are by the locking slider 71 instead of the drive member 78. Therefore, any jamming of the drive member is prevented, and the disengagement of the return stop device 70 is facilitated.

It depends upon the dispensing application whether a friction brake or a return stop device is used. By using a friction brake and upon relief of the trigger lever after dispensing the double thrust ram will be allowed to retract by the distance required to essentially prevent the continued flow of the components. By using return stop devices, the double thrust ram is locked by means of the teeth, and the pressure on the pistons of the cartridge will be maintained to some extent, thus allowing the maximizing of the dispensing stroke, i.e. the dispensed amount per stroke. Continued flow can be prevented by actuating the unlocking lever, thus releasing the locking slider as well as the double thrust ram, thereby relieving the pressure in the cartridge.

When dispensing two component cartridges, wherein the two cartridge cylinders or containers have different cross-sectional areas, e.g. in the ratio of 2:1, different reaction forces occur against the double thrust ram, which cause horizontal tilting and jamming moments. In order to avoid or to substantially reduce these moments, the point of impact of the advancing forces, i.e. the upper portion 41 of the trigger lever and the compensating link 13, respectively, may be shifted proportionately towards the side where the higher reaction forces are encountered, namely towards the cartridge having the greater cross-sectional area. It can also be that only portions of the trigger lever, or the whole trigger lever including the handle, are arranged in an offset manner.

With cartridges where the cartridge cylinders have widely different cross-sectional areas, for example in a ratio of 10:1, the arrangement shown in FIGS. 1 and 2 is not optimal since the desired lateral offset of the point of impact of the advancing forces causes an undesirable reduction of the teeth width on the thrust ram of the larger cartridge cylinder. The embodiments shown in FIGS. 7 to 11 take this condition into account in that the driving parts are disposed by the smallest possible distance below the teeth. This allows the offset required for high cartridge dispensing ratios, such as 10:1 for example, without reducing the width of the teeth.

By the lowering of the advance drive member, forces acting vertically on the drive member are created which cause additional frictional losses. These losses are significantly smaller, however, with widely different cartridge dispensing ratios, than the frictional losses which are avoided and which would otherwise be encountered by horizontal moments caused by the widely different reaction forces acting on the thrust ram. This is because the impact of forces can be shifted laterally, as shown, to the optimum value. The total advantages are that smaller tilting moments, and thus smaller frictional losses, are generated on all members of the device, efficiency is further optimized, and smaller loads are applied to the parts.

In the figures showing the following embodiments, unmodified parts are designated and referred to in the same way as in the preceding embodiments so that only new or modified parts receive new reference numbers.

Figure 7:
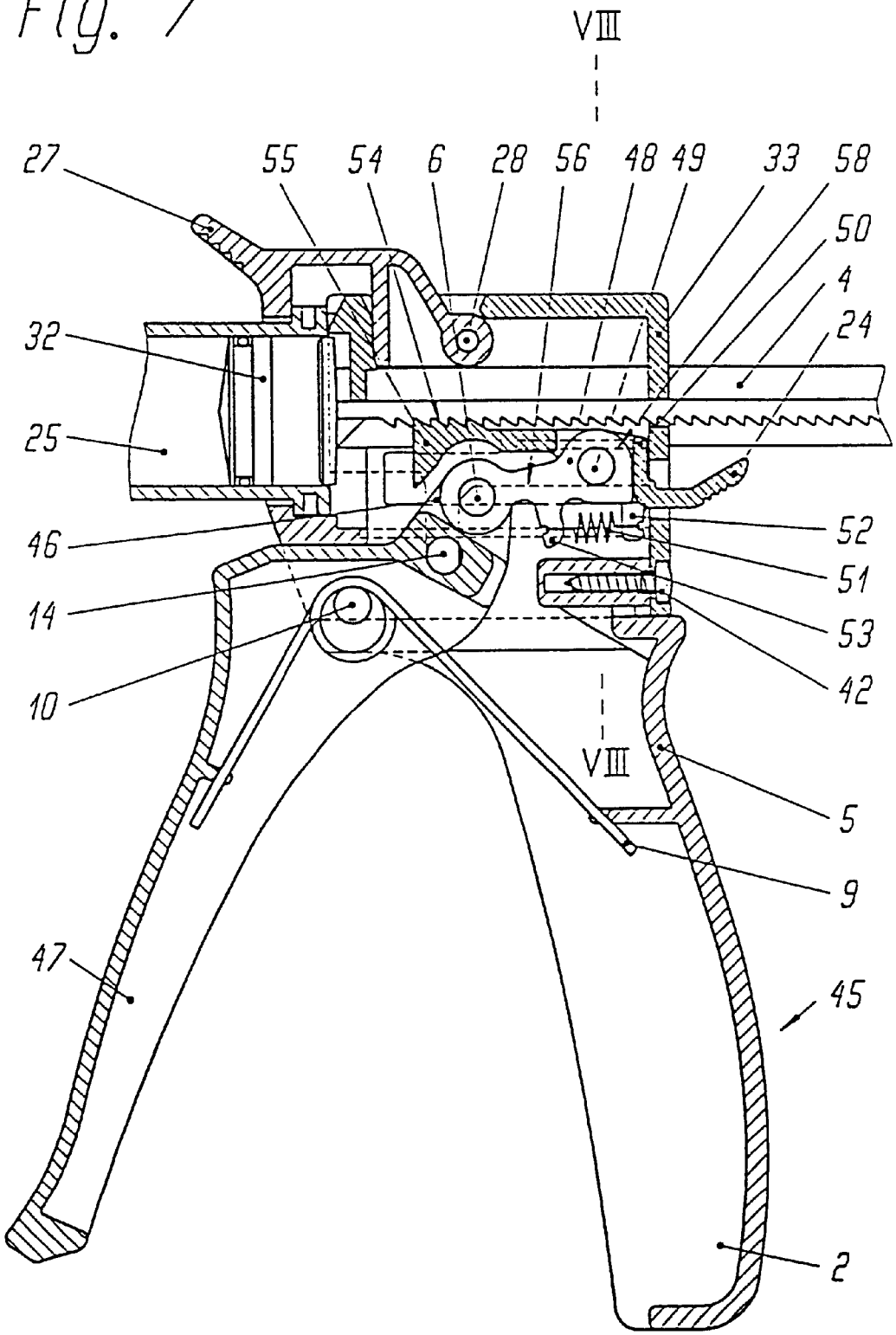
FIG. 7 shows a longitudinally sectioned view of a second embodiment of a dispensing device according to the invention.

The device 45 according to FIG. 7 is especially suited for widely different dispensing ratios. It has a similar construction as that of FIG. 1 and comprises the same handle 2, which is provided with a trigger lever 47 adapted in the upper portion 46. The trigger lever 47 acts through a drive member 50 on the double thrust ram 4 which, in turn, acts on the pressure pistons 32 of a double cartridge 25 for dispensing the two components. This handle 2 is integral with housing 5, which comprises different guides, ribs etc. as well as a cover 33 which is fastened with screws 42.

The trigger lever 47 is connected by the upper pin 6 to one end of the compensating link 48, which is connected at its other end by a pin 49 to the drive member 50. This drive member 50 is shown in detail in FIG. 8. The pin 49 constitutes the fulcrum of the drive member 50. The trigger lever 47, being disposed slightly below the upper pin 6, rotates about a pin 14 journalled in the housing. The compensating link 48 serves as an arc compensating member. The drive member 50 is charged by a tension spring 51 that is connected at one end to a nose 52 of the drive member 50 and, at the other end, to a nose 53 of the compensating link 48. The tension spring 51, in contrast to the embodiment according to FIG. 1, is located below the two pins 6 and 49, its function being the same as that of the compression spring 15, according to FIG. 1.

By positioning the drive member 50 below the teeth 18 of the double thrust ram 4, vertical jamming and tilting moments, respectively, must be accepted, but the full lateral offset of the force impact point is now possible. This offers a considerable advantage for minimizing the horizontal moments when widely different dispensing ratios are required.

Figure 8:
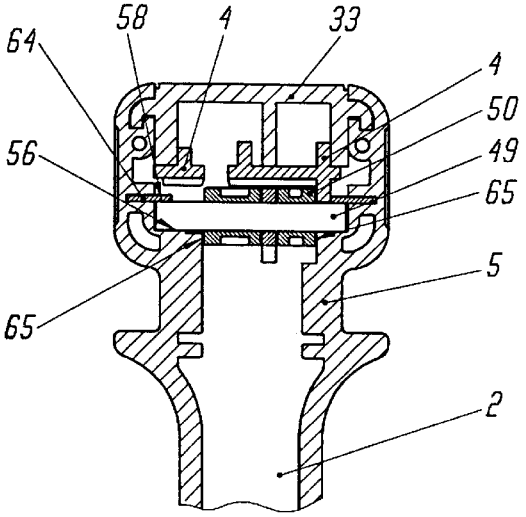
FIG. 8 shows a section of the dispensing device of FIG. 7 according to line VIII—VIII.

The trigger lever 47 is journalled and charged by the spring 9 in the same manner as that of FIG. 1. The drive member 50 comprises on its upper side, as seen in the dispensing direction, teeth 54, which is in meshing engagement with the teeth 18 of the double thrust ram 4. The guide of the compensating link 48, as shown in FIG. 8, is the same as shown in FIG. 2.

The drive member 50, which has a slide and latch like configuration, comprises, in contrast to the two arms 19 in FIG. 1, only one traversing arm 55 having teeth 54 at its upper surface. The drive member 50 is guided in the same way as in the embodiment according to FIG. 4. Differing from the embodiment according to FIG. 1, the remaining portion of the drive member 50 is guided via a pin 49 sliding upon a corresponding guiding surface 56 of the housing, as shown in FIG. 7. The drive member 50 further comprises the lever 24 for disengaging the teeth 54 of the drive member 50 from the teeth 18 on the double thrust ram 4 and against the force of the tension spring 51, in order to allow a retraction of the double thrust ram 4.

Jamming of the drive member in vertical direction is prevented by the wide horizontal support and guidance of the pin 49 and the drive member 50 respectively, between the upper guiding surface 58 and the lower guiding surface 56.

Figure 11:
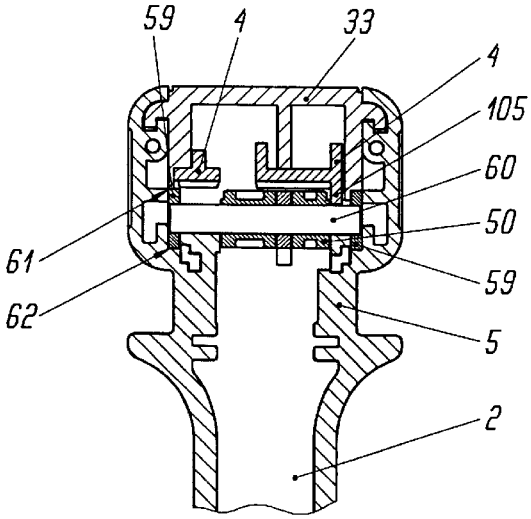
FIG. 11 shows a section of the dispensing device of FIG. 10 according to line XI—XI.
Figure 9:
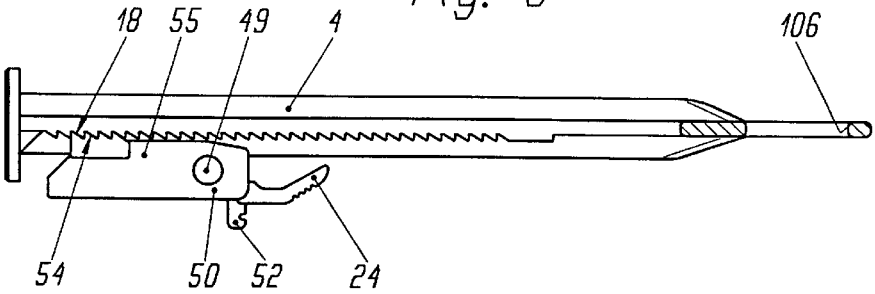
FIG. 9 shows a detail of the drive member of FIG. 7.
Figure 10:
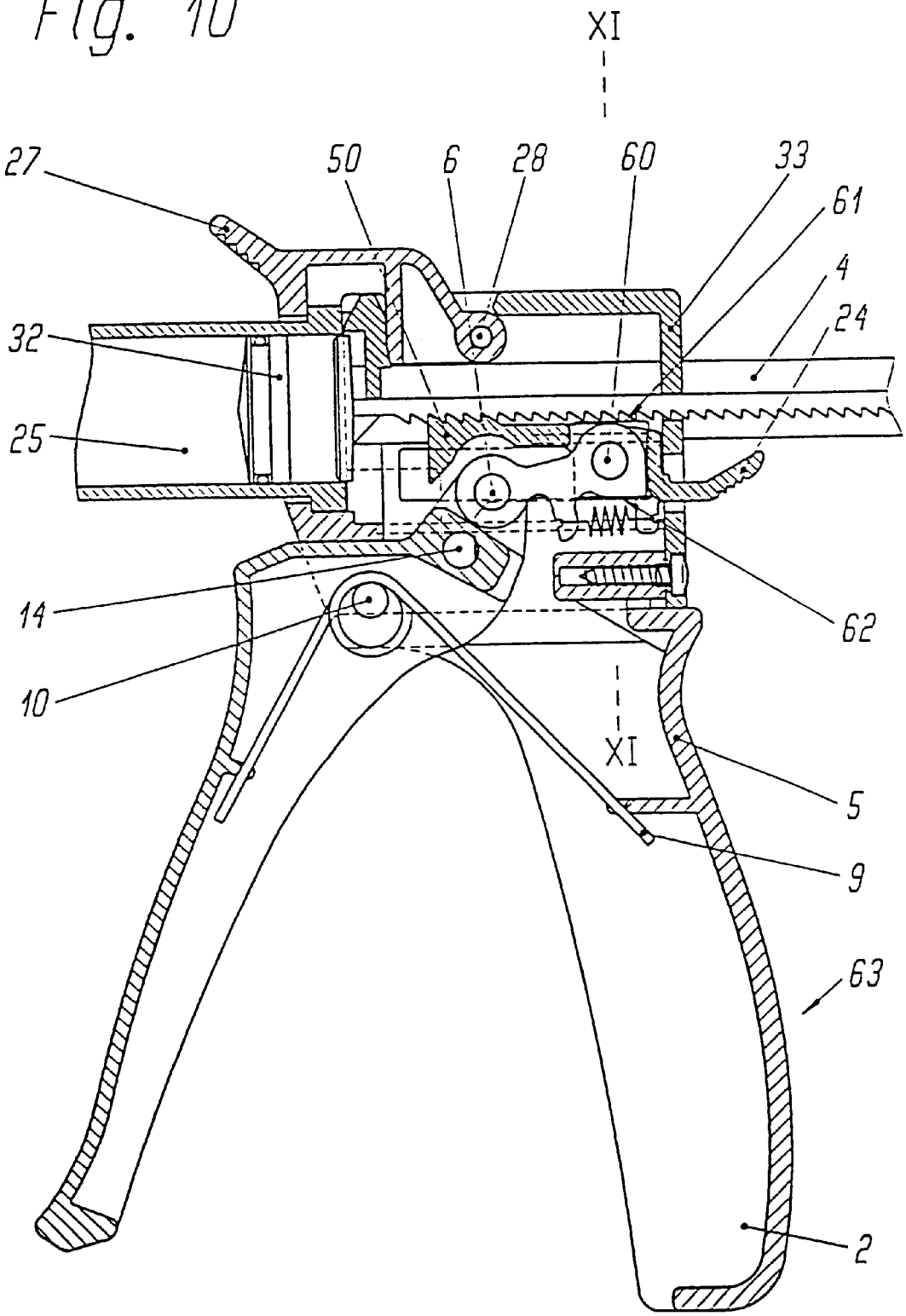
FIG. 10 shows a longitudinal section of a variant of the dispensing device of FIG. 7.

In the variant according to FIGS. 10 and 11, the guiding of the pin 60 is ensured by two sliding blocks 59. As can be seen in FIGS. 10 and 11, the sliding blocks 59 are guided above and below in guides 61 and 62 between the housing and the cover. All other parts of the device 63 of the embodiment variant according to FIGS. 10 and 11 are identical with those of FIGS. 7 to 9.

Due to supporting and guiding of the drive member 50 by means of the pin 60 or of the sliding blocks 59 on the pin, the drive member cannot deviate upwards nor downwards. The drive member 50 journalled on the pin 60 is laterally guided by guides 65 and is free to move within the housing, thus allowing it to make a linear advance and return motion during dispensing. However, it is swiveled about the pins 49 and 60 during the return stroke and during retraction of the double thrust ram 4.

The working manner of the embodiments according to the FIGS. 7 to 11 is the same as that of the first embodiment. The difference is to be found, in particular, in that the pin 49 or 60 of the drive member 50 is located below the plane of the teeth of the thrust ram 4. Thus it is possible, as can especially be seen in FIGS. 7 and 10, to dispose the teeth 54 of the drive member 50 at will on the width of the double thrust ram 4 and, further, to set the lateral impact point of the force exerted by trigger lever 47 and compensating link 48 in an optimum manner. This ensures that a sufficiently wide set of teeth can be maintained even with widely different dispensing ratios, for example 10:1. In addition, the lowest possible horizontal moments are obtained as the result of the different thrust ram reaction forces. It therefore follows that a maximum efficiency can be attained even with extreme dispensing ratios, whereas the increased vertical tilting moments caused by lowering of the force impact point have, by comparison, only a relatively small influence.

Figure 5A:
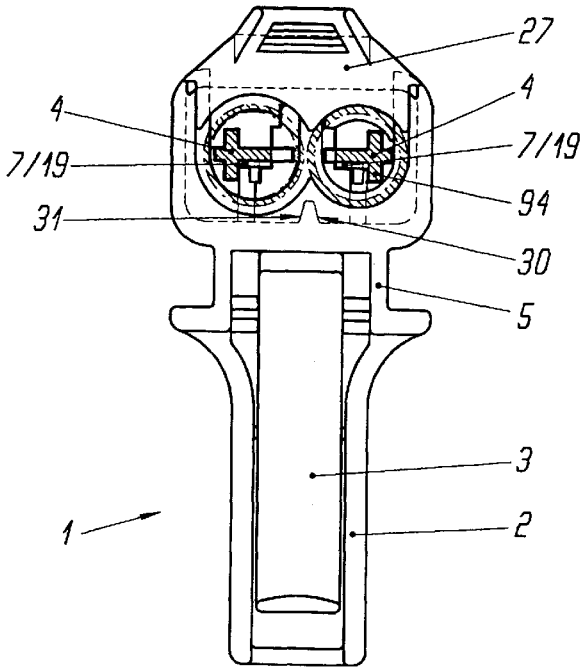
FIG. 5A shows the dispensing device of FIG. 1 in a front view.
Figure 12:
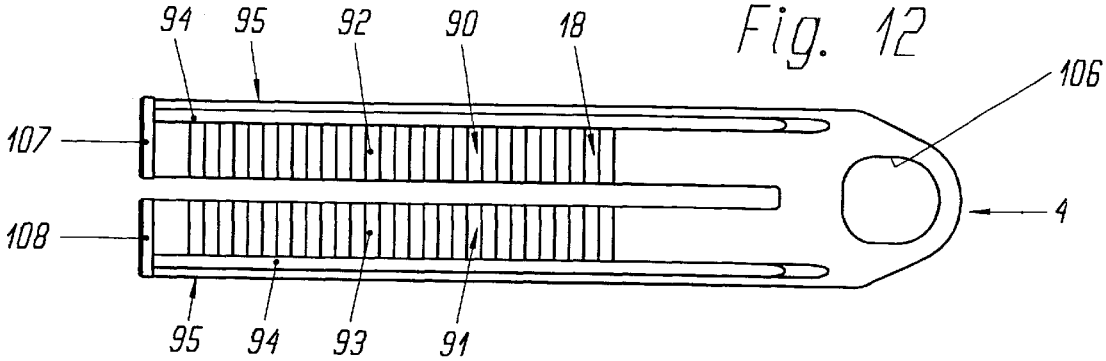
FIG. 12 shows a view on the toothed surface of the thrust ram of FIG. 5A.

FIG. 12 is a view of the toothed thrust ram 4 of FIG. 5A with the two toothed thrust ram parts 90 and 91 having approximately the same width, which corresponds to a dispensing ratio of approximately 1:1. As illustrated, the teeth 18 of the double thrust ram comprise teeth 92 and 93. In order to ensure maximum transmission of the force between the trigger lever 3 via drive member 7 (with teeth 17) to the thrust ram 4 (with teeth 18), the teeth 92 and 93 of the respective thrust ram parts 90 and 91 are preferably as wide as possible. To make this possible, the rib 94 of thrust ram parts 90 and 91 is moved toward the outer edges 95 of the thrust ram parts.

Figure 5B:
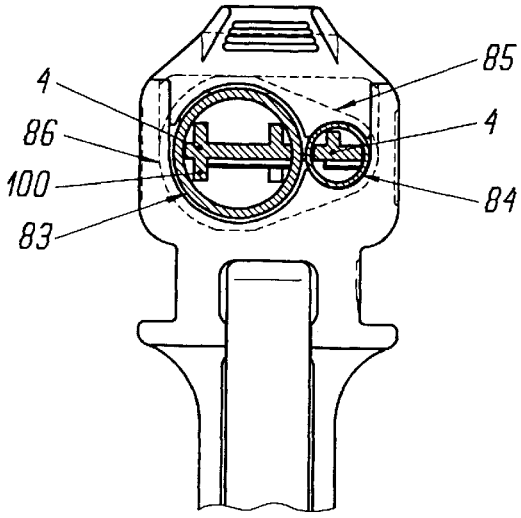
FIG. 5B shows a variant of the device according to FIG. 5A, FIGS. 6A and 6B show a variant of execution of the dispensing device of FIG. 1 in two positions.
Figure 13:
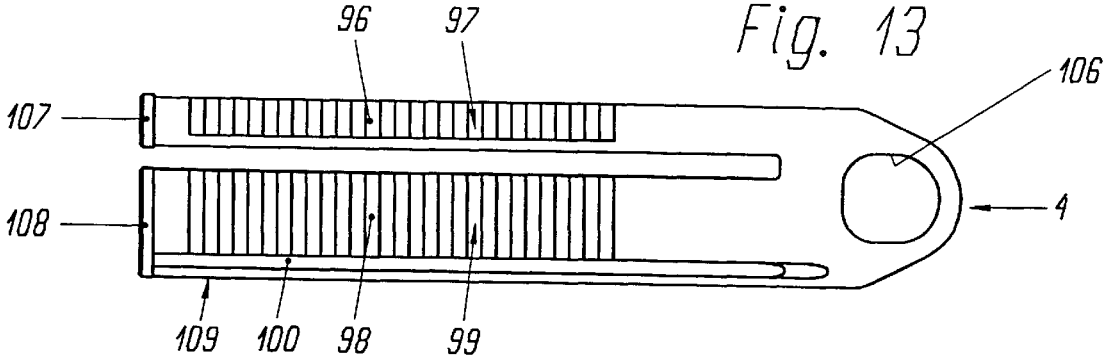
FIG. 13 shows a view on the toothed surface of the thrust ram of FIG. 5B.

FIG. 13 is a view of the toothed surface of thrust ram 4 of FIG. 5B. In this alternative embodiment, teeth 96 of thrust ram part 97 are not limited by a rib, thus enabling a maximum transmission of force. Further, as illustrated in FIG. 13, the thrust ram part 99 is wider than the thrust ram part 97. Teeth 98 of the wider thrust ram part 99 are wider than teeth 96, and, in this example, are limited by a rib 100 at the outer edge 109.

Figure 14:
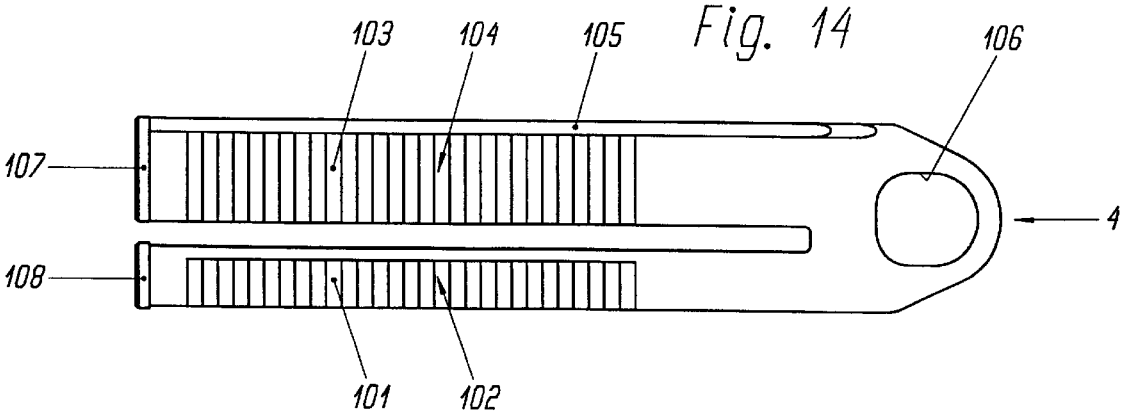
FIG. 14 shows a view on the toothed surface of the thrust ram of FIG. 11.

FIG. 14 is a view of the toothed surface of the thrust ram of FIG. 11. As shown, a thrust ram part 102 is narrower than a thrust ram part 103. Thrust ram part 102 has a set of teeth 101 that are narrower than teeth 103 of the wider thrust ram part 104. In this example, teeth 101 are not limited by ribs. As a result, in contrast to the embodiment according to FIG. 13, the wider teeth 103 of wider thrust ram part 104 are limited by one rib 105 only, which is arranged near the edge of thrust ram part 104.

The thrust rams 4 are further provided with a handling opening 106. In addition, a ram plate 107, 108 is provided for each thrust ram part. It is evident that the higher transmission force is realized by forming the teeth 17 of the drive member 7 with a width corresponding to the width of the teeth 18 of the thrust ram 4.

It will be apparent to those skilled in the art that this principle of utilizing the widest possible teeth on the thrust ram parts is not only applicable to the present embodiments of the invention described herein, but also to other known manually operated dispensing devices, including the prior art cited herein.

Returning to the description of FIG. 1, shown is a cartridge 25 which has been inserted and secured in an attachment means 26 of the dispensing device. The holding device comprises a retaining flap 27. Retaining flaps are thoroughly described in detail in EP-B-0,543,776 of the same Applicant. In the device according to FIG. 1, the retaining flap 27 is pivoted about an axle 28, as also indicated in FIG. 2, whereas the transmission of the retaining forces occurs directly onto the housing and not via the pivoting axle 28. The retaining flap 27 has, as seen in its cross-section, a U-shaped part whose first leg 38 retains the upper part of flange 29 of the cartridge and whose second leg 39 rests against a step 40 of the housing. The retaining flap designed in this manner has the effect of properly retaining the entire cartridge flange 29, which avoids flexing of the flange, and directly transmitting the retaining forces onto the housing with the pivot of the flap relieved from a load.

With different cartridge dispensing ratios or for the connection of a coded mixer, it may become necessary to insert the cartridges in the same orientation into the dispensing device so that a coding between the cartridge and the dispensing device will offer advantages. Such a coding may be achieved, for example, by a projection or nose 30 (FIG. 5A) on the device and a corresponding notch 31 on the cartridge. This measure ensures that a cartridge cannot be inserted in an erroneous manner, or that an incorrectly inserted cartridge cannot be dispensed. The locations of the projection cam 30 and the notch 31 can also be interchanged.

A further coding can be achieved according to FIG. 5B, where the cylinders 83 and 84, having different diameters, lead to an asymmetric cartridge flange 85 whose outline serves as a coding means. The attachment means 86 of the device is correspondingly shaped so that the cartridge can only be introduced and locked in one orientation.

The other parts, members of the device and the flap, are similar to the example according to FIGS. 5A and 7, but without a projection and notch.

Such coding means are not only applicable to the described device but can be applied generally to any insertion of cartridges into dispensing devices if a defined orientation is required.

Based on the foregoing description, it will be understood that the present invention provides a dispensing device which overcomes the disadvantages mentioned above when cartridges of the same or widely different diameters are used, and which has a higher efficiency and a drive means less sensitive to becoming inoperable by contamination. Specifically, this is achieved by a manually operated dispensing device wherein the drive member is guided in such a manner that it is hindered from making any tilting motion or any motion transversely to the advance direction during its advance stroke but can effect a swiveling motion for allowing its disengagement from the double thrust ram for its return stroke or for unlocking the double thrust ram for grip regain.

It will be further understood that the invention provides a dispensing device which, with the same dimensions, is able to transmit a considerably higher force from the trigger lever via a drive member to the thrust rams and is especially adapted for use with thrust rams made of plastic material. This is achieved with a dispensing device wherein the toothed surface of the thrust ram parts are provided with ribs, the ribs being arranged near the outer edges of the thrust ram parts, resulting in a maximum width of the set of teeth. Alternatively, it is achieved with a device wherein the thrust ram parts are not be provided with ribs, and wherein the teeth extend from one edge to the other edge of the thrust ram parts, resulting in a maximum width of the set of teeth.

Further, it will be appreciated that the present invention provides a manually operated dispensing device having a return stop device that is better suited for maximizing the dispensed amount per stroke than the device of EP-A-0,615,787. This is attained by a device wherein the dispensing device comprises a return stop device having a locking slider acting on the teeth of the double thrust ram.

The principles, preferred embodiments, and modes of operation of the present invention have now been described. The invention is not intended to be construed as limited to the particular forms disclosed, because these are regarded as illustrative rather than restrictive. It will be understood that variations and changes may be made by those of ordinary skill in the art without departing from the spirit of the invention.

I claim:

1. A manually operated dispensing device for use with a double cartridge for dispensing two-component chemical systems, the device comprising:

a double thrust ram with two thrust ram parts, each thrust ram part having a single toothed surface on which teeth are provided, the width of the thrust ram parts being approximately equal; and a drive assembly acting on the double thrust ram and actuated by a trigger lever, the drive assembly including a drive member which has teeth for acting on the teeth of the double thrust ram;

wherein the toothed surface of the thrust ram parts is provided with ribs, said ribs being arranged near the outer edges of said thrust ram parts to maximize a width of the teeth of the thrust ram parts.

2. A manually operating dispensing device according to claim 1, wherein the drive assembly further includes an arc compensating link arranged between the drive member and the trigger lever, the arc compensating link being connected for rotation at one of its ends through an upper pin to the trigger lever and at its other end through a fulcrum pin to the drive member.

3. A manually operating dispensing device according to claim 2, wherein the drive member is guided in such a manner that it is hindered from making any tilting motion or any motion transversely to the advance direction during its advance stroke but can effect a swiveling motion for allowing its disengagement from the double thrust ram for its return stroke or for regaining its grip with the double thrust ram following disengagement.

4. A manually operated dispensing device according to claim 2, wherein the double thrust ram includes two plungers, each plunger corresponding to a respective one of the thrust ram parts, and wherein the point of impact of forces on the upper pin of the trigger lever and the fulcrum pin of the drive member are located between the two plungers and at the level of the teeth of the thrust ram parts.

5. A manually operating dispensing device according to claim 1, wherein the double thrust ram includes a portion apart from the thrust ram parts, the portion defining a handling opening.

6. A manually operating dispensing device according to claim 5, wherein the double thrust ram includes a pair of ram plates, each ram plate being provided for a respective one of the thrust ram parts.

7. A manually operated dispensing device according to claim 1, wherein the dispensing device comprises a return stop device having a locking slider acting on the teeth of the double thrust ram.

8. A manually operated dispensing device according to claim 7, wherein the return stop device comprises an unlocking lever acting on the locking slider, said unlocking lever being arranged in such a way that the drive member disengages from the teeth of the double thrust ram before the locking slider.

9. A manually operated dispensing device according to claim 8, wherein the locking slider is activated by a nose of the unlocking lever, so that during manual actuation of the unlocking lever, the locking slider can be disengaged from the teeth of the double thrust ram.

10. A manually operated dispensing device according to claim 9, wherein the unlocking lever comprises two legs, the first leg being formed as said nose and the second leg being formed as an actuating lever followed by a radial cam coacting with a projection of the drive member in such a manner that the projection of the drive member and the locking slider are actuated sequentially in time by said nose.

11. A manually operated dispensing device according to claim 7, wherein the locking slider is loaded by a compression spring, and the unlocking lever by a leg spring.

12. A manually operated dispensing device according to claim 7, comprising a double dispensing cartridge, wherein the cartridge comprising a flange is held in an attachment means and secured by a retaining flap, the retaining flap being connected to and pivoting about the housing and positively retaining the flange of the cartridge from behind.

13. A manually operated dispensing device according to claim 12, wherein the retaining flap, seen it its cross-section, comprises a U-shaped part whose first leg retains the cartridge flange from behind and whose second leg abuts against a step of the housing, for transmitting the retaining forces directly onto the housing.

14. A manually operated dispensing device according to claim 7, wherein the cartridge and the dispensing device are provided with coding means in such a manner that the cartridge can be inserted into said attachment means in one predetermined orientation only.

15. A manually operated dispensing device according to claim 14, wherein the coding means comprises a projection at the dispensing device and a notch at the cartridge, or vice versa.

16. A manually operated dispensing device according to claim 14, wherein the coding means comprise a contoured attachment means and an asymmetric cartridge flange whose shape essentially follows the outline of the different cartridge cylinders.

17. A manually operated dispensing device according to claim 1, wherein the drive member is configured to pull the teeth of the double thrust ram.

18. A manually operated dispensing device according to claim 1, wherein the toothed surface of each thrust ram part is provided with a single rib arranged near one outer edge of the thrust ram part.

19. A manually operated dispensing device for use with a double cartridge for dispensing two-component chemical systems, the device comprising:

a double thrust ram with two thrust ram parts, each thrust ram part having a toothed surface on which teeth are provided, one of the thrust ram parts being wider than the other thrust part; and a drive assembly acting on the double thrust ram and actuated by a trigger lever, the drive assembly including a drive member which has teeth for acting on the teeth of the double thrust ram, wherein the toothed surface of the wider thrust ram part is provided with a rib arranged near an outer edge of the wider thrust ram part to maximize a width of the teeth of the wider thrust ram part, and wherein the toothed surface of the other thrust ram part has no ribs to maximize a width of the teeth of the other thrust ram part.

20. A manually operating dispensing device according to claim 19, wherein the drive assembly further includes an arc compensating link arranged between the drive member and the trigger lever, the arc compensating link being connected for rotation at one of its ends through an upper pin to the trigger lever and at its other end through a fulcrum pin to the drive member.

21. A manually operating dispensing device according to claim 20, wherein the drive member is guided in such a manner that it is hindered from making any tilting motion or any motion transversely to the advance direction during its advance stroke but can effect a swiveling motion for allowing its disengagement from the double thrust ram for its return stroke or for regaining its grip with the double thrust ram following disengagement.

22. A manually operated dispensing device according to claim 20, wherein the double thrust ram includes two plungers, each plunger corresponding to a respective one of the thrust ram parts, and wherein the point of impact of forces on the upper pin of the trigger lever and the fulcrum pin of the drive member are located between the two plungers and at the level of the teeth of the thrust ram parts.

23. A manually operating dispensing device according to claim 19, wherein the double thrust ram includes a portion apart from the thrust ram parts, the portion defining a handling opening.

24. A manually operating dispensing device according to claim 23, wherein the double thrust ram includes a pair of ram plates, each ram plate being provided for a respective one of the thrust ram parts.

25. A manually operated dispensing device according to claim 19, wherein the dispensing device comprises a return stop device having a locking slider acting on the teeth of the double thrust ram.

26. A manually operated dispensing device according to claim 25, wherein the return stop device comprises an unlocking lever acting on the locking slider, said unlocking lever being arranged in such a way that the drive member disengages from the teeth of the double thrust ram before the locking slider.

27. A manually operated dispensing device according to claim 26, wherein the locking slider is activated by a nose of the unlocking lever, so that during manual actuation of the unlocking lever, the locking slider can be disengaged from the teeth of the double thrust ram.

28. A manually operated dispensing device according to claim 27, wherein the unlocking lever comprises two legs, the first leg being formed as said nose and the second leg being formed as an actuating lever followed by a radial cam coacting with a projection of the drive member in such a manner that the projection of the drive member and the locking slider are actuated sequentially in time by said nose.

29. A manually operated dispensing device according to claim 25, wherein the locking slider is loaded by a compression spring, and the unlocking lever by a leg spring.

30. A manually operated dispensing device according to claim 25, comprising a double dispensing cartridge, wherein the cartridge comprising a flange is held in an attachment means and secured by a retaining flap, the retaining flap being connected to and pivoting about the housing and positively retaining the flange of the cartridge from behind.

31. A manually operated dispensing device according to claim 30, wherein the retaining flap, seen it its cross-section, comprises a U-shaped part whose first leg retains the cartridge flange from behind and whose second leg abuts against a step of the housing, for transmitting the retaining forces directly onto the housing.

32. A manually operated dispensing device according to claim 25, wherein the cartridge and the dispensing device are provided with coding means in such a manner that the cartridge can be inserted into said attachment means in one predetermined orientation only.

33. A manually operated dispensing device according to claim 32, wherein the coding means comprises a projection at the dispensing device and a notch at the cartridge, or vice versa.

34. A manually operated dispensing device according to claim 32, wherein the coding means comprise a contoured attachment means and an asymmetric cartridge flange whose shape essentially follows the outline of the different cartridge cylinders.

35. A manually operated dispensing device for use with a double cartridge for dispensing two-component chemical systems, the device comprising:

a double thrust ram with two thrust ram parts, each having a single toothed surface on which teeth are provided; and a drive assembly acting on the double thrust ram and actuated by a trigger lever, the drive assembly including a drive member which has teeth for acting on the teeth of the double thrust ram, wherein the teeth of the toothed surface of the thrust ram parts extend from one edge to another edge of the thrust ram parts to maximize a width of the teeth of the thrust ram parts.

36. A manually operating dispensing device according to claim 35, wherein the drive assembly further includes an arc compensating link arranged between the drive member and the trigger lever, the arc compensating link being connected for rotation at one of its ends through an upper pin to the trigger lever and at its other end through a fulcrum pin to the drive member.

37. A manually operating dispensing device according to claim 36, wherein the drive member is guided in such a manner that it is hindered from making any tilting motion or any motion transversely to the advance direction during its advance stroke but can effect a swiveling motion for allowing its disengagement from the double thrust ram for its return stroke or for regaining its grip with the double thrust ram following disengagement.

38. A manually operated dispensing device according to claim 36, wherein the double thrust ram includes two plungers, each plunger corresponding to a respective one of the thrust ram parts, and wherein the point of impact of forces on the upper pin of the trigger lever and the fulcrum pin of the drive member are located between the two plungers and at the level of the teeth of the thrust ram parts.

39. A manually operating dispensing device according to claim 35, wherein the double thrust ram includes a portion apart from the thrust ram parts, the portion defining a handling opening.

40. A manually operating dispensing device according to claim 39, wherein the double thrust ram includes a pair of ram plates, each ram plate being provided for a respective one of the thrust ram parts.

41. A manually operated dispensing device according to claim 35, wherein the dispensing device comprises a return stop device having a locking slider acting on the teeth of the double thrust ram.

42. A manually operated dispensing device according to claim 41, wherein the return stop device comprises an unlocking lever acting on the locking slider, said unlocking lever being arranged in such a way that the drive member disengages from the teeth of the double thrust ram before the locking slider.

43. A manually operated dispensing device according to claim 42, wherein the locking slider is activated by a nose of the unlocking lever, so that during manual actuation of the unlocking lever, the locking slider can be disengaged from the teeth of the double thrust ram.

44. A manually operated dispensing device according to claim 43, wherein the unlocking lever comprises two legs, the first leg being formed as said nose and the second leg being formed as an actuating lever followed by a radial cam coacting with a projection of the drive member in such a manner that the projection of the drive member and the locking slider are actuated sequentially in time by said nose.

45. A manually operated dispensing device according to claim 41, wherein the locking slider is loaded by a compression spring, and the unlocking lever by a leg spring.

46. A manually operated dispensing device according to claim 41, comprising a double dispensing cartridge, wherein the cartridge comprising a flange is held in an attachment means and secured by a retaining flap, the retaining flap being connected to and pivoting about the housing and positively retaining the flange of the cartridge from behind.

47. A manually operated dispensing device according to claim 46, wherein the retaining flap, seen it its cross-section, comprises a U-shaped part whose first leg retains the cartridge flange from behind and whose second leg abuts against a step of the housing, for transmitting the retaining forces directly onto the housing.

48. A manually operated dispensing device according to claim 41, wherein the cartridge and the dispensing device are provided with coding means in such a manner that the cartridge can be inserted into said attachment means in one predetermined orientation only.

49. A manually operated dispensing device according to claim 48, wherein the coding means comprises a projection at the dispensing device and a notch at the cartridge, or vice versa.

50. A manually operated dispensing device according to claim 48, wherein the coding means comprise a contoured attachment means and an asymmetric cartridge flange whose shape essentially follows the outline of the different cartridge cylinders.

* * * * *